US008122539B1

(12) United States Patent
Miranda

(10) Patent No.: US 8,122,539 B1
(45) Date of Patent: Feb. 28, 2012

(54) CLIMATE CONTROL AND ENTERTAINMENT ENCLOSURE

(76) Inventor: Osvaldo Miranda, Lakeland, FL (US)

( * ) Notice: Subject to any disclaimer, the term of this patent is extended or adjusted under 35 U.S.C. 154(b) by 373 days.

(21) Appl. No.: 12/489,392

(22) Filed: Jun. 22, 2009

(51) Int. Cl.
*A47C 27/00* (2006.01)
*F25D 23/12* (2006.01)

(52) U.S. Cl. ..... 5/423; 5/284; 5/414; 62/259.1; 62/261

(58) Field of Classification Search ..... 5/284, 414, 5/423; 62/259.1, 261, 263
See application file for complete search history.

(56) References Cited

U.S. PATENT DOCUMENTS 2,154,638 A * 4/1939 Reeves ..... 454/370
2,159,741 A 5/1939 Kettering et al.
2,188,078 A * 1/1940 Eakin ..... 5/284
2,461,432 A 2/1949 Mitchell
2,573,455 A * 10/1951 Koontz ..... 5/284
3,362,469 A 1/1968 Berner et al.
3,505,989 A * 4/1970 Truhan ..... 600/21
3,611,743 A * 10/1971 Manganaro ..... 62/263
4,129,123 A * 12/1978 Smidak ..... 600/21
4,594,817 A 6/1986 McLaren et al.
5,165,126 A * 11/1992 Jones ..... 5/414
5,317,907 A * 6/1994 Shimizu et al. ..... 62/176.6
5,459,893 A * 10/1995 Walters, III ..... 5/414
6,446,455 B1 * 9/2002 Sohn et al. ..... 62/298
6,725,484 B2 4/2004 Drenik
6,916,238 B2 7/2005 Korman
6,945,064 B2 * 9/2005 Jebaraj ..... 62/259.1

* cited by examiner

*Primary Examiner* — Michael Trettel
(74) *Attorney, Agent, or Firm* — Luis Figarella

(57) ABSTRACT

An apparatus for climate control and entertainment, as well as a system for maximizing energy efficiency and comfort are disclosed. The apparatus affords the ability to control ambient conditions while at the same offering enhanced entertainment options.

12 Claims, 7 Drawing Sheets

CLIMATE CONTROL AND ENTERTAINMENT ENCLOSURE

FIELD OF THE INVENTION

The present invention generally relates to the field of climate control, specifically with respect to systems and methods that may be used in entertainment, living and sleeping modules. These may be used in medical, industrial, commercial and other related applications.

BACKGROUND OF THE INVENTION

The invention of Air Conditioning and the advent of small, affordable units capable of cooling a home created a revolution in all tropical and sub-tropical climates. In the Unites States, it was suddenly possible to live in areas with high temperature/high humidity summers (such as the Southeast). Similarly, the advent of efficient, fossil fueled heating units has allowed much more comfortable lives for those living in the far North/South regions of the planet.

Over time, the development of automated climate control systems led to very comfortable living spaces with little or no human intervention. Coupled with the availability of materials, and due to the volume rule, the volumetric space being climate controlled in a modern house did not double (as did the home area, but quadrupled). In recent time, energy costs have risen, and it is expected that they will continue to rise for the foreseeable future.

Kettering et al, U.S. Pat. No. 2,159,741 teaches a bed enclosure having an air conditioned unit connected to it. However, in his case, the A/C exhaust (the heat exchanged from the enclosure) is exhausted into the space next to the bed. Since in most homes this would be the actual bedroom where the bed is, this is disadvantageous. Most of us would resent leaving a bed enclosure at 20° C., only to exit into a Bedroom at 35° C.

McClaren et al U.S. Pat. No. 4,594,817 teaches a solution for this problem, by providing a conduit through which conditioned air (Heated or Cooled) can be piped to the unit. While this is perfect for a commercial/industrial application, most homes are not equipped with compressors for routing air at the pressures required to make this work.

There exists a need in the art for an energy efficient solution that would deliver climate control to a subset of the living volume within a dwelling, in particular to the volume occupied by dwellers during significant periods of time, such as the living and entertainment areas, all with out requiring significant changes to the living quarters.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

The invention is directed towards the climate control and entertainment of occupants within an enclosure that represents a fraction of a space or room within a dwelling, in order to save energy. Such an enclosure system or apparatus presenting a reduced volume to cool/heat/condition, used at the moment when people are most sedentary takes advantage of their limited mobility and space need during these situations.

With such a system, users will be capable of reducing their energy needs, while preserving the comfort they have been accustomed to.

Some aspects of the invention are directed to the climate control of the enclosures, the rooms/spaces they are in, as well as the linking through electronic means of one or more of these enclosures to a dwelling climate control. By using advances in climate control methods, particularly the use of mini-split air conditioning and heating units, and linking the operation of one or more of these units, the system allows for increases in efficiency of home climate control means, something of importance as energy costs continue to increase.

In one embodiment of the invention, it takes the form of an enclosure with integrated air handler function climate control linked to a central unit heat exchange function through heat transfer medium, and electronic controls of time and parameters of operation and the ability to enrich the experience by allowing the control of other units within a dwelling via the control interface.

In another embodiment of the invention, it takes the form of a heating enclosure capable of reducing the volume of space heated during times when the user is located within the enclosure, allowing for the reduction of heating expenses.

Other objects, features and advantages of the present invention will become apparent upon examining the following detailed description of an embodiment thereof, taken in conjunction with the attached drawings. The present invention may be implements in many forms including a device, method, or part of a device.

BRIEF DESCRIPTION OF THE DRAWINGS

The foregoing discussion will be understood more readily from the following detailed description of the invention with reference to the following drawings. The accompanying drawings are not intended to be drawn to scale. In the drawings, each identical or nearly identical component that is illustrated in various figures is represented by a like numeral. For purposes of clarity, not every component may be labeled in every drawing. In the drawings.

DEFINITIONS

As used herein, the term "plurality" refers to two or more items or components.

The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

DETAILED DESCRIPTION OF THE PREFERRED EMBODIMENT

To provide an overall understanding of the invention, certain illustrative embodiments will now be described, including apparatus and methods for displaying images. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

Figure 1:
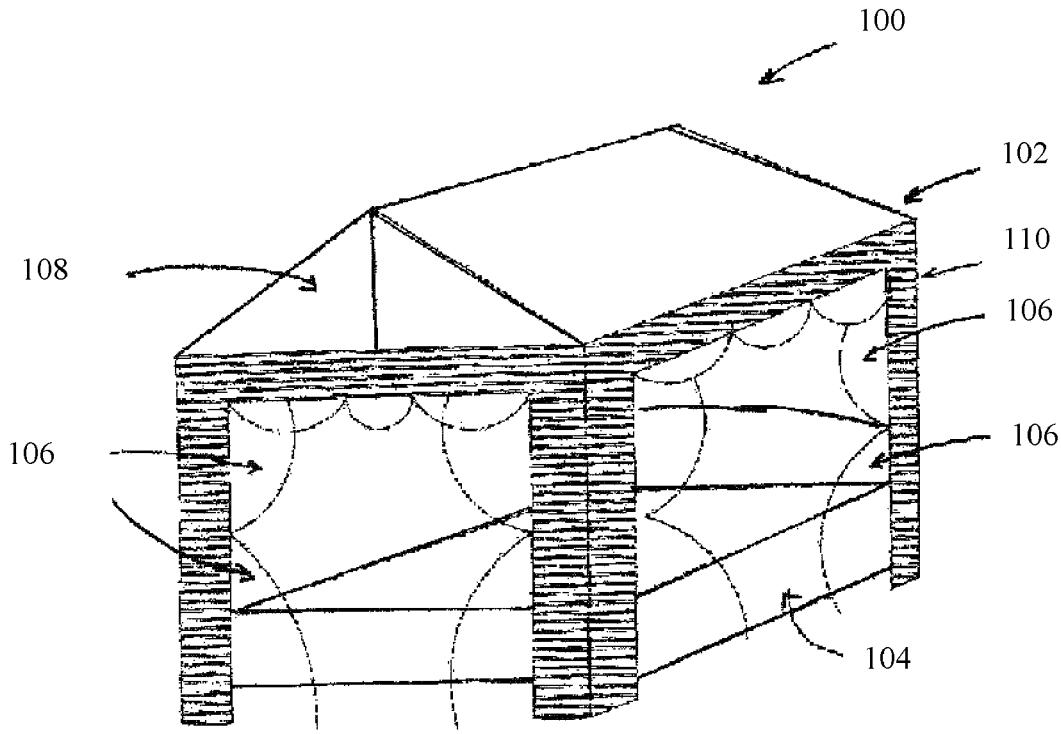
FIG. 1 is an exemplary illustration of a climate control and entertainment enclosure system, according to an illustrative embodiment of the invention.

FIG. 1 illustrates an overall view of the climate control enclosure structure 100. In one embodiment, each enclosure 102 consists of a structure defining a volume, including a ceiling holding a canopy and columns capable of defining walls. The structure is capable of enclosing one or more beds 104, sofas or other human resting structures. It also supports the air flow containment means 106 for keeping the conditioned air within the desired volumetric limits of the enclosure 100. In one embodiment, the structure consists of one or more posts, which are placed at each of four corners of the structure, creating a support structure with a top canopy structure for housing air exchange means, lights, speakers, entertainment and other assemblies. Other structures (circular, externally supported, etc.) capable of defining a volume may be used.

The air flow containment means may include flexible or solid curtains, (which themselves may be either transparent or light inhibiting), solid or flexible walls, doors, windows and other such means. In addition, air curtains may also be used to provide for an enclosure with no solid walls. Finally, light, partially air transmitting means (such as mosquito nets) or shadow nets, may be used in locations where a very light amount of air constraint is required to keep the enclosure comfortable. The heart of the system is the splitting of the air acclimatization system, so that the air handler function portion of the system is located within the canopy 108 atop the enclosure structure 110.

Figure 2:
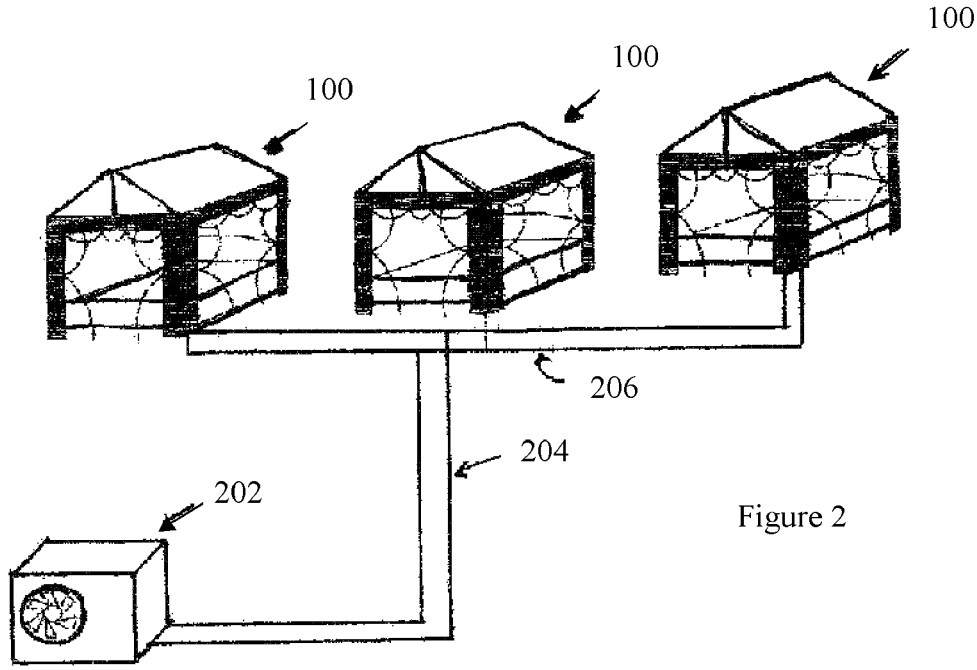
FIG. 2 is an exemplary illustration of the invention when a single condense/heat source and multiple air handling/evaporator coils are used, according to an illustrative embodiment of the invention.

As seen in FIG. 2, in one embodiment, the climate control enclosure system eliminates severe limitations of previous systems by utilizing a multi-split system when cooling or heating the enclosure. Such a split system separates the heat exchange function (usually performed by a heater or Compressor/Condenser/Chiller/Evaporator) from the air exchange function, utilizing a heat exchange medium to connect both. The heat exchange function (effectively the cooling or hearting of a heat exchange medium above or below the ambient temperature) is performed by a HEF unit 202 (hereafter referred to as the Heat Exchange function) located outside the room where the enclosure is being used (or even in some embodiments outside the home where the enclosures are being used).

The air handler/air temperature/air exchange portion of the system (hereafter referred to as the air handler function or AHF), is performed within the room or area holding the enclosure. The actual AHF unit 302 serves as an interface between the air within the air envelope of the enclosure and the air within the room or area outside the enclosure (which may be outdoors). In one embodiment, this AHF is located within the canopy 108 of the enclosure. The lines 204, 206 are used to move the heat transfer medium (be it Freon, chilled/heated water or brine, air or other appropriate energy transfer mediums). In another embodiment, the air exchange is located below the bed contained within the enclosure.

Figure 3:
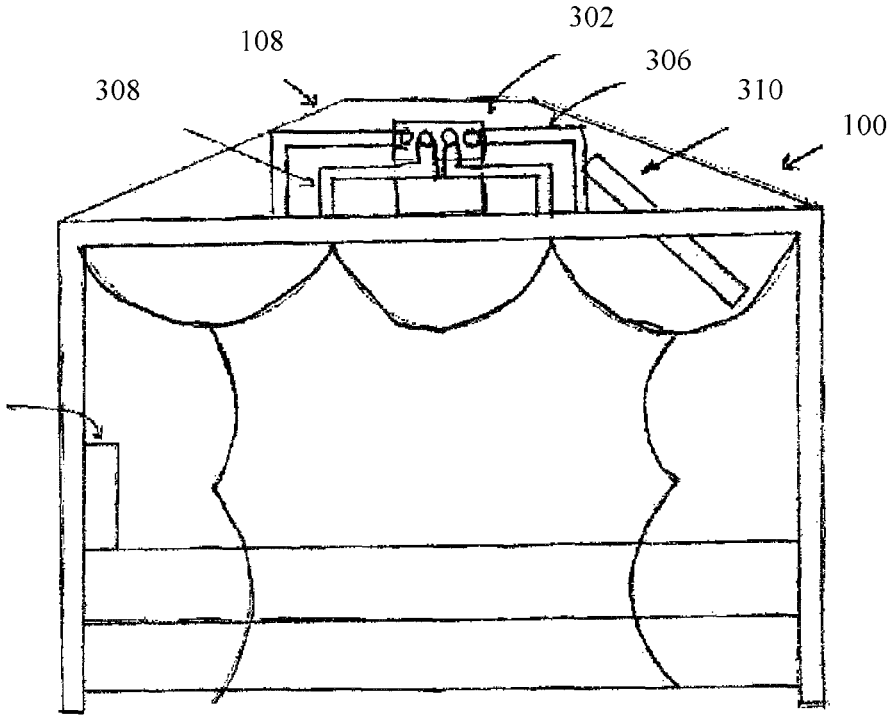
FIG. 3 is an exemplary illustration of a side view of the climate control enclosure, according to an illustrative embodiment of the invention.

The separation of the HEF 202 from the AHF 302 provides a novel and significant advantage over Kettering (as seen in FIG. 3). In such an embodiment, allowing only the AHF 302 portion of the unit to be located within the room where the enclosure 100 is located avoids the heat input (generated from the heat within the enclosure as well as from the heat generated by the HEF mechanism itself) into the room (an unavoidable by-product of units as tough by Kettering).

In addition, as seen in the illustrative embodiment in FIG. 2 in homes where multiple enclosures are contained, provides for the correct sizing of the AHF to the volume being cooled. Since this volume of the enclosure is significantly smaller than that of the room or rooms containing one or more enclosures each, this results in the system being correctly sized to the volume being cooled, avoiding the over-heating/over-cooling effect so common to rooms with temperature control systems that are over-sized, all (again, because of the volume rule) still being done with significantly less energy use than when cooling a complete room.

The aforementioned mini-split embodiment also results in a significant noise reduction from the conditioning system, for the HEF 202 is located outside the room. In addition to the noise, the embodiment allows all heat and humidity to be deposited outside the cooled and livable space. In one embodiment, active noise cancellation means may be built into the speakers of the enclosure to cancel any humming from the air exchanger or the air curtains. Such a setup would require noise pickup microphones in the area near the user resting position.

As seen in the illustrative embodiment shown in FIG. 3, in one embodiment, each enclosure contains its own temperature sensing 304, capable of measuring the temperature within the enclosure, as well as outside the enclosure. In alternate embodiments, this may also include Humidity and other human comforts measurements. Similarly, emergency sensors such as fire, carbon monoxide and other health threatening conditions may be linked to the system electronics. In one embodiment, this would ensure that all lights within the linked enclosures flash in a predetermined fashion, and optional alarms be sounded in order to alert the users. Similarly, the speakers within the enclosures may be used as microphones in order to permit communication between enclosures. In addition, the ability to flash the lights may be linked to a house deaf-assistance systems (such as TTY terminals and doorbells), in order to assist those with hearing disabilities.

In addition, in one embodiment, individual control means to control and adjust both the desired enclosure temperature, as well as air flow controls are included. In one mode, the control means allow the unit to work in an Automatic or Auto mode, where the user simply programs the desired temperature, per period of time. Other modes include specific temperature, as well as specific air volume controls. One or more of the units may be equipped with Master or Supervisor control means of all or a number of the other units in the system, as well as interfaces to the overall building climate control system.

In one embodiment, the system works only as a de-humidifier, allowing the occupants to reduce their energy costs (for example they may be away for the weekend) while ensuring their furnishings and other possessions are not exposed to environmental extremes. In an alternate embodiment, all of the above is accomplished with a heat-pump system, allowing for the efficient heating of the spaces. Other embodiments may be accomplished with heating systems. In locations with dry conditions, the unit may be equipped with a swamp cooler or mister, capable of creating a pleasant environment to occupants without active cooling of the air.

In one embodiment, we can see on placement of the AHF 302 unit within the canopy. We can see the ducts 306, 308 that are used to bring the conditioned air to the enclosure. The bottom of AHF 302 serves as the input, interfacing the air handler to the enclosure. In an alternate embodiment, a filter may be placed here in order to maintain the systems ducts free of dust and other contaminants. Keeping the AHF 302 within the canopy 108 provides for a space in which to enclose it and reduce any noise effects produced by its operation.

In one embodiment, one or more of the ducts are directed to the room (instead of the enclosure). Their opening/closing is controlled by the unit controller, and its operation is targeted at having some control over the conditions of the room within which the unit is contained. In one example, the unit may be commanded to reduce/increase the temperature of the room a period of time before the user programmed wake up time, in order to make the wake up ablutions (going to the bathroom, getting dressed) more pleasant. Again, these conditions may be set by the individual enclosure user, the Master User, or the system itself.

In one embodiment, when only one enclosure is being used, and the HEF 202 is using so little energy that in effect it would use the same amount of energy to cool/heat one enclosure as to do some more work and keep the humidity or temperature of other enclosures or rooms in line with desired objectives programmed by the user or master user.

In one embodiment, the system is capable of controlling airflow using dampers located within its ducts or vents, as well as interfacing to the house or dwelling climate control system to regulate the dampers/vents and other components of that system.

Figure 4:
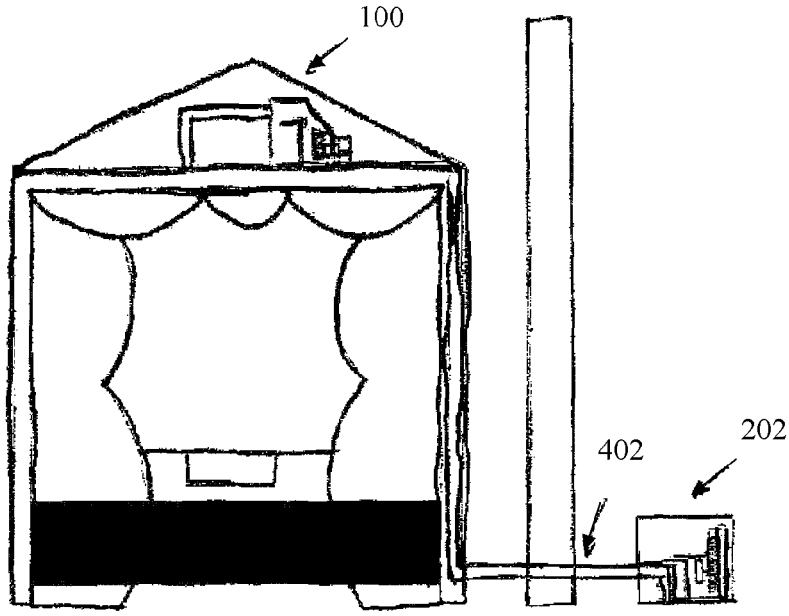
FIG. 4 is an exemplary illustration of another side view of the climate control enclosure, according to an illustrative embodiment of the invention.

In one embodiment, the enclosure is enhanced by the inclusion of audio and video equipment. One embodiment may include an audio visual entertainment system with a control unit 304, speakers, a flat screen monitor 310, and means for raising/lowering it into the canopy. The control unit 304, includes media inputs, such as Internet, DVD, CD, Radio, Television, Memory and other entertainment options. FIG. 4 illustrates the unit in connection to the outside HEF 202, via the connection channel 402.

Figure 5:
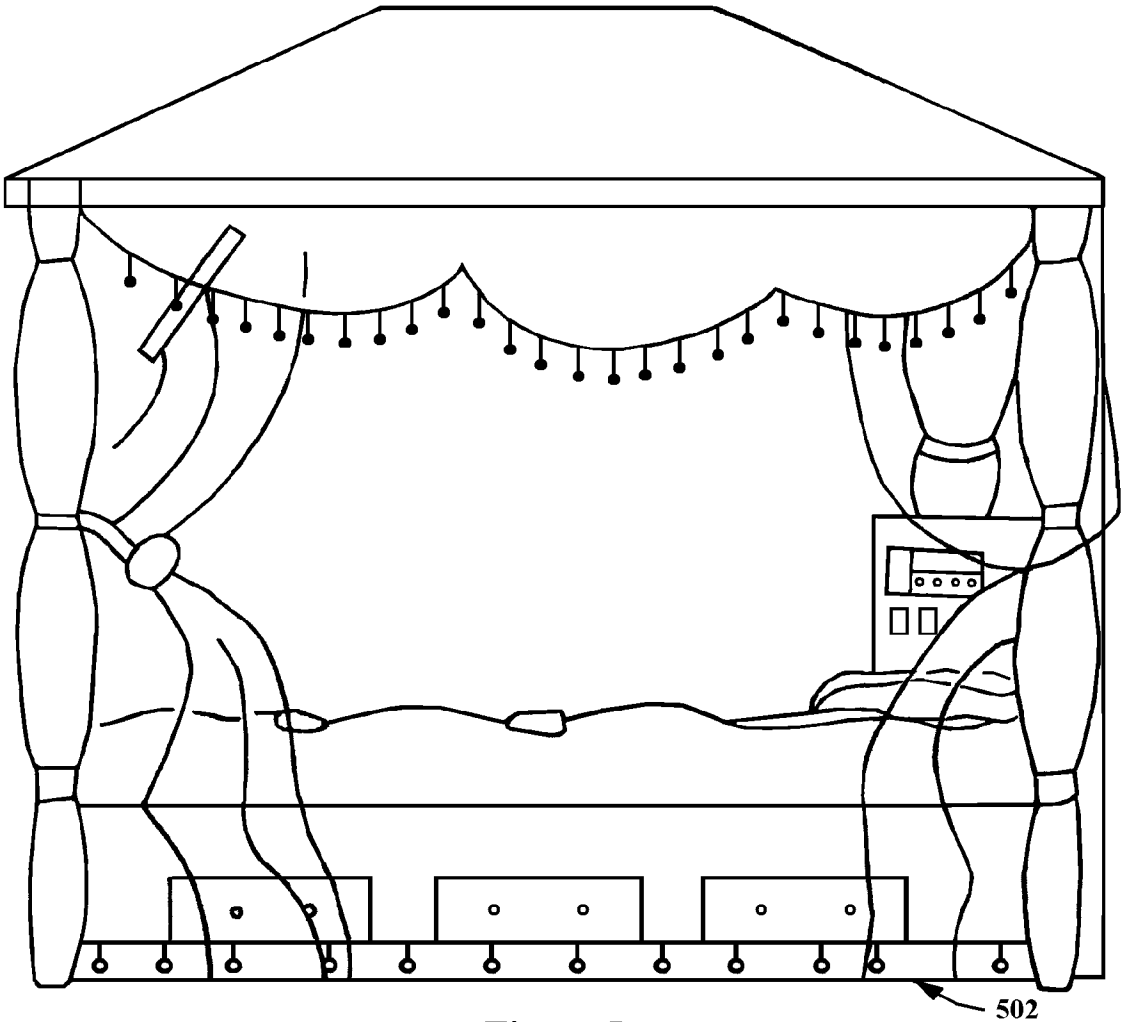
FIG. 5 is an exemplary illustration of the a side view of the climate control enclosure, according to an illustrative embodiment of the invention.
Figure 6:
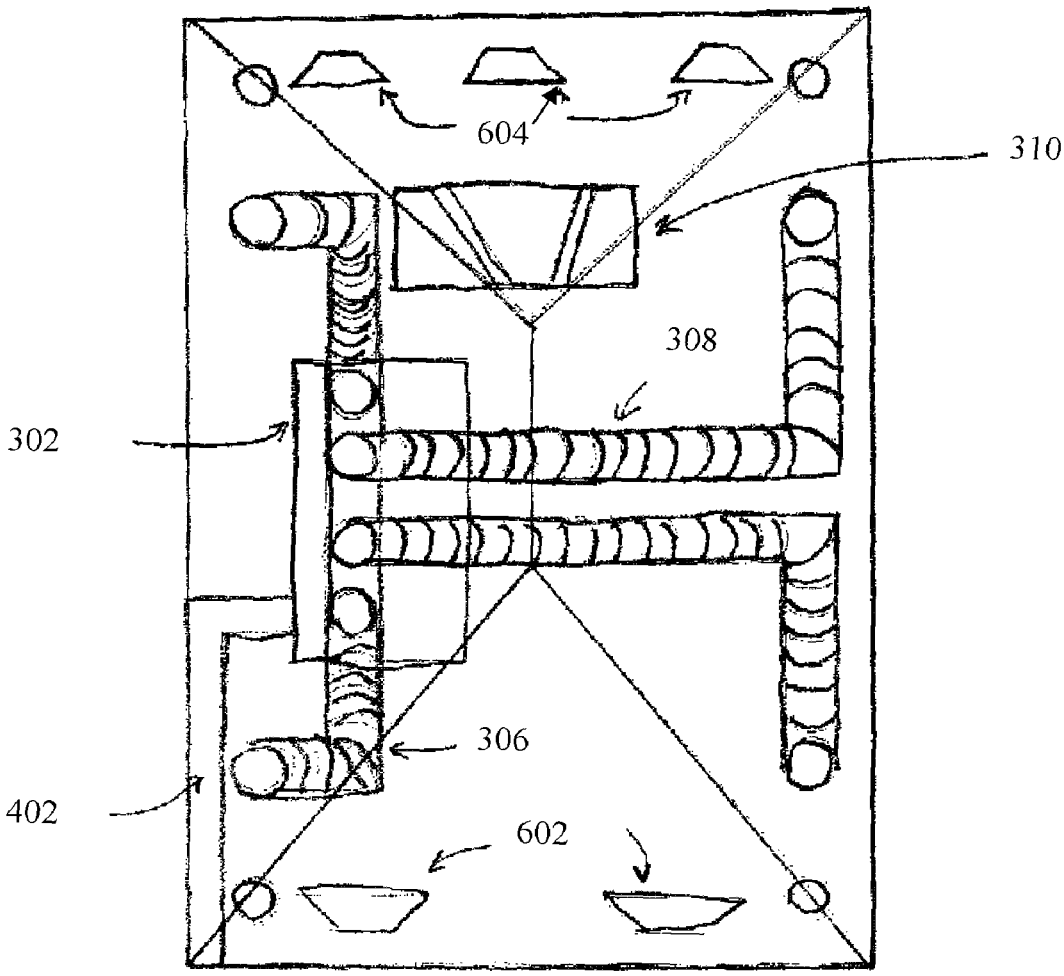
FIG. 6 is an exemplary illustration of the top view of the climate control enclosure, according to an illustrative embodiment of the invention.

FIG. 5 illustrates an alternate embodiment of the system. In this embodiment, the lower portion of the enclosure is equipped with water collecting surface 502 for collection of any moisture that may condense. A float-switch assembly is used to activate a heater or ultrasonic transducer to generate a humidifier stream that may then be directed by ducts to the user's desired location. FIG. 6 illustrates the top view of one embodiment. In it, we can see the flat screen 310, speakers and lights 602, 604, ducts 306, 308, and other components.

Figure 7:
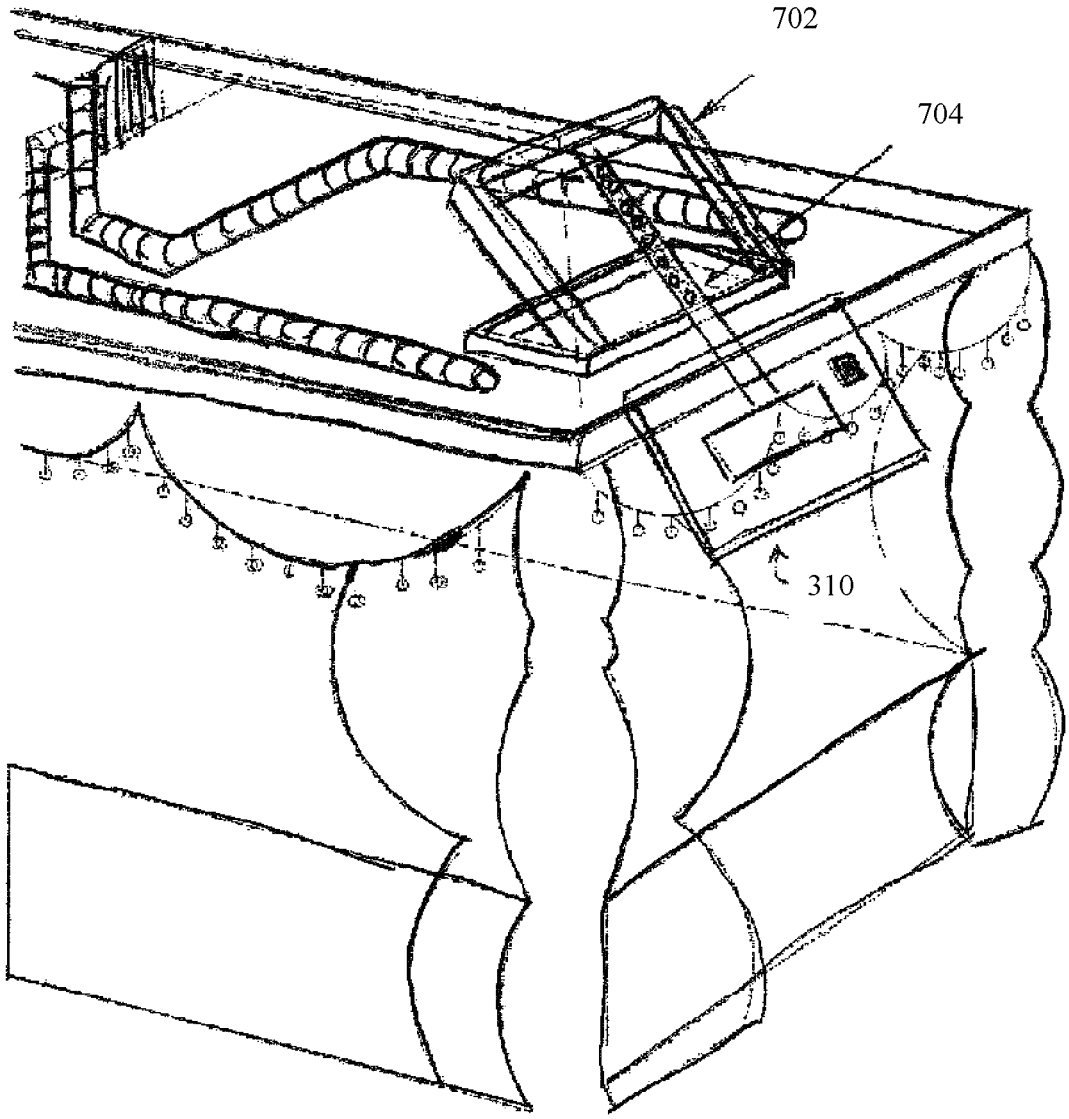
FIG. 7 is an exemplary illustration of an isometric view of the climate control enclosure inside the canopy, according to an illustrative embodiment of the invention.
Figure 8A:
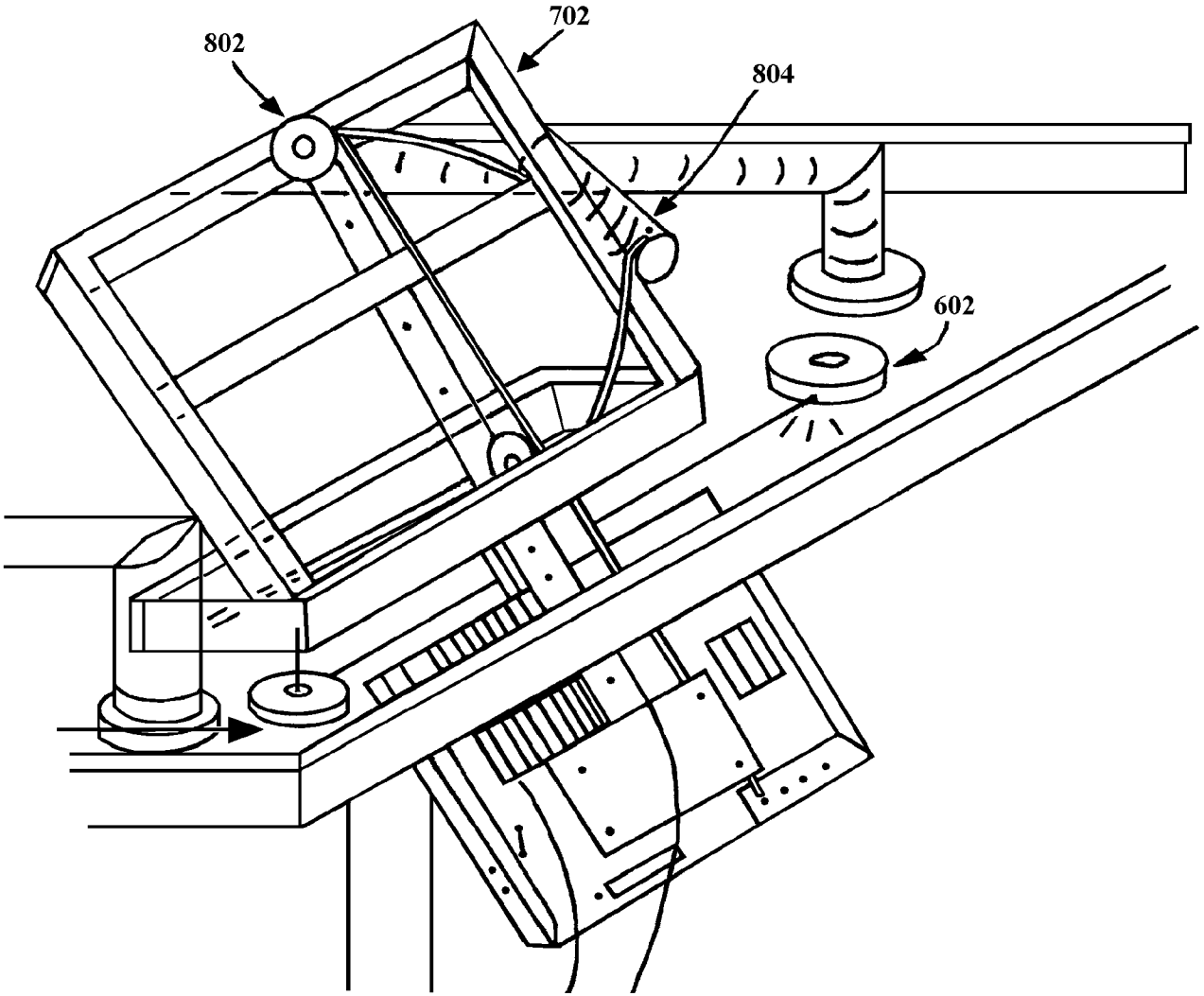
FIGS. 8A and 8B are exemplary illustrations of an isometric view (8A) and side/top views (8B) of the mechanism for moving the monitor into/out of the canopy enclosure, according to an illustrative embodiment of the invention.
Figure 8B:
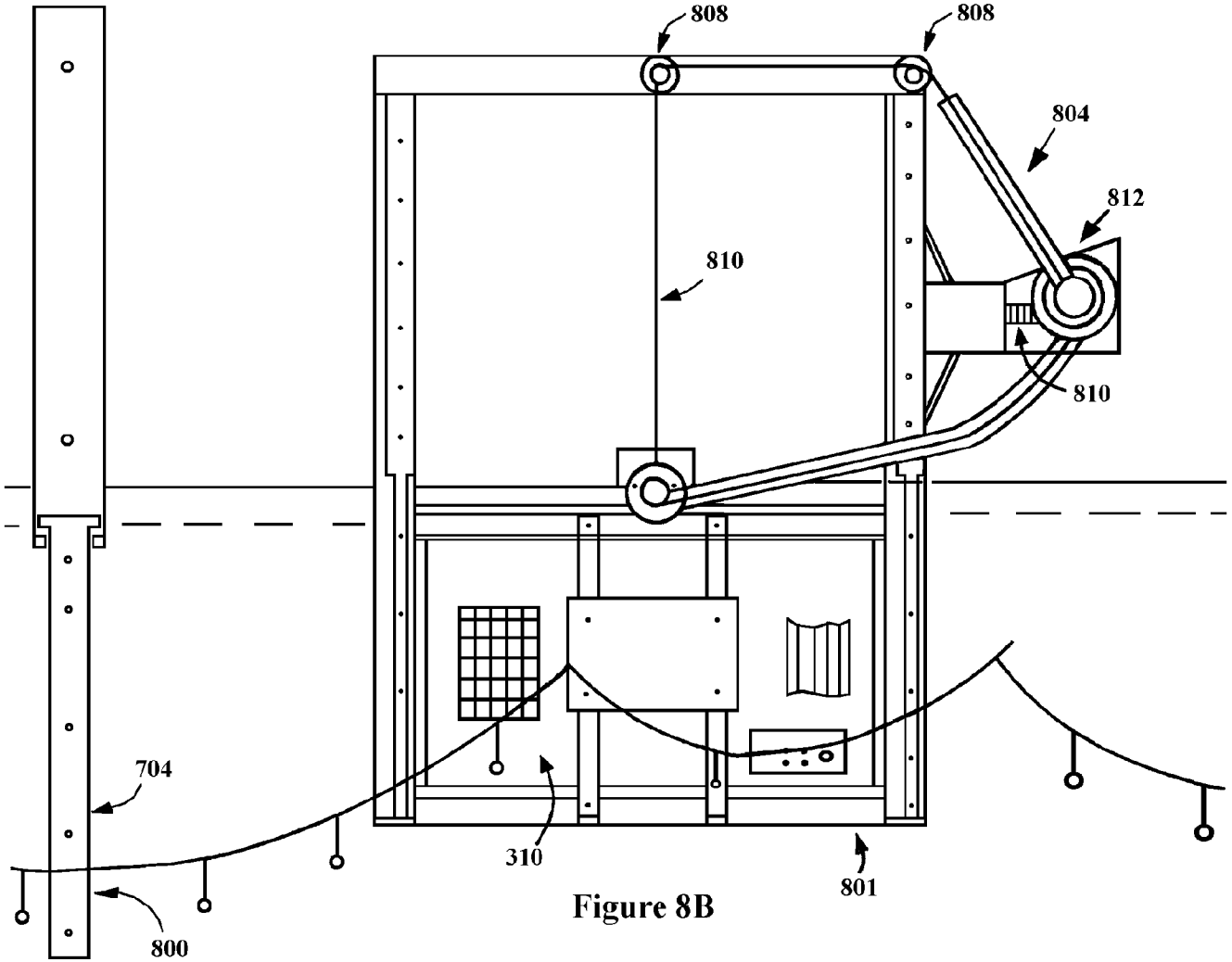

FIG. 7 provides an exemplary embodiment of a mechanism for lowering and raising the monitor 310. In one embodiment, a frame 702 holding the edges of rails 704 that hold the monitor is used. As seen in further detail in FIGS. 8A and 8B, the frame 702 is in one embodiment held at an angle, and pulleys 808 and cable 806 mechanism 802 connects to an actuator 804. Within the actuator, a circular motor 812 and spring 810 are used to move the cable and lower/raise the monitor 310 in response to user input on the control 304 panel. The ability to enclose the screen when not in use, by inserting it into the canopy enclosure is an advantage of the system, allowing more space within the enclosure, as well as an advantageous viewing angle.

To facilitate the raising and lowering of the monitor, a spring 810 is used to minimize the weight of the monitor. By having that pre-stress on the cable/pulley mechanism 802, it cancels the weight of the monitor 310. In this fashion the load on the actuator 804/812 is minimized. The monitor 310 then moves up, with the edges held within the rails 704.

In alternate embodiments, the actuator 804 may be a mechanical spring, electronic motor, air/hydraulic/pneumatic actuator in some embodiments. They may be actuated by the enclosure user, as well as overridden by the Master user (the inventor has kids!), or by a set of parameters entered by the master user on the central control computer.

Having now described some illustrative embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives.

Further, acts, elements, and features discussed only in connection with one embodiment are not intended to be excluded from a similar role in other embodiments. It is to be appreciated that various alterations, modifications, and improvements can readily occur to those skilled in the art and that such alterations, modifications, and improvements are intended to be part of the disclosure and within the spirit and scope of the invention. Thus, for example, retrofitting existing devices is contemplated by the invention.

Moreover, it should also be appreciated that the invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in the claims.

Use of ordinal terms such as "first", "second" and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any preferred embodiments are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. The invention may be embodied in other specific forms without departing from the spirit or essential characteristics thereof. The forgoing embodiments are therefore to be considered in all respects illustrative, rather than limiting of the invention. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

I claim:

1. An apparatus comprising;

an air climatizing structure defining an envelope of air, said climatizing structure being located significantly within a room, and containing air temperature sensors;

air flow containment means for said climatizing structure;

air climatizing means interfacing with the air inside said climatizing structure, said air climatizing means comprising at least a fan unit and an evaporator coil;

heat exchange means located outside the room containing said climatizing structure, said heat exchange means comprising at least a compressor unit, a condenser coil and a condenser fan;

piping capable of carrying a Heat transfer medium between said air climatizing means to and said heat exchange means, said heat transfer medium being in a liquid state when it travels from the heat exchange means to the air climatizing means, and in a gaseous state when it travels from the air climatizing means to the heat exchange means; and control means capable of sensing the temperature within said envelope of air and controlling said air climatizing and heat exchange means in order to achieve a desired temperature within said envelope of air.

2. The apparatus of claim 1 further comprising;

a bed located within the air climatizing structure.

3. The apparatus of claim 2 further comprising;

an audio visual entertainment system located within the air climatizing structure.

4. The apparatus of claim 1 further comprising;

an audio visual entertainment system located within the air climatizing structure.

5. The apparatus of claim 1 wherein;

two or more air function means, each installed within an air climatizing structure are linked to one heat transfer means.

6. A system comprising;

Two or more air climatizing structures, each defining an individual envelope of air, said climatizing structures each being located significantly within one or more rooms and containing individual air temperature sensors;

individual air flow containment curtains for each said air climatizing structure;

individual air climatizing units interfacing with the air inside each said climatizing structure, each said air climatizing unit being comprised of at least a fan unit and an evaporator coil;

a central heat exchange unit located outside either room containing said climatizing structures, said heat exchange unit being comprised of at least a compressor unit, a condenser coil and a condenser fan;

piping capable of carrying a Heat transfer medium between said air climatizing units and said central heat exchange unit, said heat transfer medium being in a substantially liquid state when it travels from the heat exchange unit to any of the air climatizing units, and in a substantially gaseous state when it travels from any of the air climatizing units to the heat exchange unit; and control means capable of sensing the individual temperature within each said envelope of air and controlling each individual air climatizing unit and the central heat exchange unit in order to achieve an individually desired temperature within the air in each air climatizing structure.

7. The system of claim 6 further comprising;

a bed located within one or more of the air climatizing structures.

8. The apparatus of claim 7 further comprising;

an audio visual entertainment system located within one or more of the air climatizing structure.

9. The apparatus of claim 6 further comprising;

an audio visual entertainment system located within one or more of the air climatizing structure.

10. A method of providing an air climatizing structure with climate control comprising the steps of:

providing an air climatizing structure defining an envelope of air;

providing air flow containment means for said air climatizing structure;

providing air climatizing means interfacing with the air inside said structure, said air climatizing means comprising at least a fan unit and an evaporator coil;

providing heat exchange means located outside the room containing said climatizing structure, said heat exchange means comprising at least a compressor unit, a condenser coil and a condenser fan;

providing a Heat transfer medium linking said air climatizing means to said heat exchange means said heat transfer medium being in a liquid state when it travels from the heat exchange means to the air climatizing means, and in a gaseous state when it travels from the air climatizing means to the heat exchange means; and providing control means capable of commanding said air climatizing and heat exchange means in order to achieve a desired temperature within said envelope of air.

11. The method of claim 10 further comprising;

placing a bed within one or more of the air climatizing structures.

12. The method of claim 10 further comprising;

providing an audio visual entertainment system located within one or more of the air climatizing structures.

* * * * *